US006463638B1

(12) United States Patent
Pontaoe

(10) Patent No.: US 6,463,638 B1
(45) Date of Patent: Oct. 15, 2002

(54) BUCKLE ASSEMBLY INCLUDING STRAP RETAINER

(75) Inventor: John Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/712,114

(22) Filed: Nov. 14, 2000

(51) Int. Cl.[7] ..... A44B 11/26

(52) U.S. Cl. ..... 24/614; 24/615; 24/616; 24/163 R; 24/625; 24/633

(58) Field of Search ..... 24/614, 616, 615, 24/163 R, 177, 169, 174, 625, 629, 633; 297/484, 467

(56) References Cited

U.S. PATENT DOCUMENTS 2,551,165 A * 5/1951 Rochat ..... 2/333
3,639,948 A * 2/1972 Sherman ..... 24/632
4,171,555 A 10/1979 Bakker et al.
4,677,711 A 7/1987 Anscher
5,243,741 A * 9/1993 Fudaki et al. ..... 24/197
5,269,051 A 12/1993 McFalls
5,283,933 A 2/1994 Wiseman et al.
5,438,737 A * 8/1995 Anscher et al. ..... 24/615
5,584,106 A * 12/1996 Anscher ..... 24/615
5,606,783 A 3/1997 Gillis et al.
5,651,166 A 7/1997 Lundstedt
5,659,931 A 8/1997 Anscher
5,709,014 A 1/1998 Takahashi
5,774,947 A 7/1998 Anscher
5,813,097 A 9/1998 Woellert et al.
5,984,358 A * 11/1999 Mar et al. ..... 24/163 R
5,991,986 A 11/1999 Canna et al.
5,996,192 A 12/1999 Haines et al.
6,049,954 A 4/2000 Britto
6,052,875 A 4/2000 Fudaki
6,076,237 A * 6/2000 Goorhouse ..... 24/200
6,247,213 B1 * 6/2001 Uehara ..... 24/265 BC

* cited by examiner

*Primary Examiner*—Robert J. Sandy
*Assistant Examiner*—André Jackson
(74) *Attorney, Agent, or Firm*—Pauley Petersen Kinne & Erickson

(57) ABSTRACT

A strap retainer for a buckle assembly wherein a strap retaining portion defines a slot. One or more teeth are positioned along the strap retaining portion and extend into the slot. At least one tooth is positioned along an inner edge of the strap retaining portion. The buckle assembly may further include a first mating portion and a second mating portion, each having the strap retaining portion, that engage with a centrally-positioned housing.

21 Claims, 3 Drawing Sheets

BUCKLE ASSEMBLY INCLUDING STRAP RETAINER

BACKGROUND OF THE INVENTION

1. Field of the Invention

This invention relates to a strap retainer for a buckle assembly to retain a strap in a fixed position and still permit adjustability.

2. Description of Related Art

Buckle assemblies such as those contemplated by this invention are used in a wide range of applications including backpacks, child safety seats, strollers and other applications that require a releasable connection between straps. Such straps are either fixed or adjustable relative to the buckle assembly. In an adjustable arrangement, the strap is fed through a mating portion and/or a housing of the buckle assembly and may be tightened or loosened depending on a length desired for the adjustable strap.

In addition, buckle assemblies may require a three- or five-way arrangement to permit the adjustment and/or fastening of multiple straps into a central housing. Such arrangements may additionally require both fixed and adjustable straps connected with respect to one or more components of the buckle assembly.

SUMMARY OF THE INVENTION

A buckle assembly is desired that permits a strap to be secure with respect to the buckle assembly and yet adjustable relative to the buckle assembly. One or more straps are connected with respect to a housing including one or more engageable mating portions. Each mating portion preferably engages with the housing in a fixed manner until released.

The one or more straps are preferably engaged with a mating portion through a strap retainer. The strap retainer includes a strap retaining portion forming a slot through which a strap is fed. The strap retainer preferably retains the strap in a fixed position that permits adjustment when desired by the user.

A plurality of teeth are preferably positioned along the strap retaining portion and extend into the slot. The teeth may be generally arcuate shaped or have any feasible alternative cross-section. Teeth preferably form a beveled leading edge and are positioned longitudinally along the strap retaining portion. According to one preferred embodiment of this invention, at least two of the teeth are spaced along an outer edge of the strap retaining portion and at least one tooth is positioned along the inner edge of the strap retaining portion. The strap is positioned within and through the slot and contacts at least three teeth, at least two teeth on a first side of the strap and at least one tooth on a second side 6*f* the strap.

A specific buckle assembly contemplated by this invention is a five-way buckle comprising the housing and two or more mating portions engageable with the housing. Each of the mating portions includes a strap retaining portion defining a slot. Although not specifically described, this invention may be used in connection with one-way, two-way, three-way, four-way and/or six or more way buckles.

In such a buckle assembly, one strap is positioned within the first mating portion and second strap is positioned within the second mating portion. Each of the first mating portion and the second mating portion preferably engage the housing directly adjacent to each other and are preferably independently removeable and engageable with respect to each other and the housing.

It is one object of this invention to provide a buckle assembly that retains an adjustable strap in a fixed position until adjustment is desired.

It is another object of this invention to provide a strap retainer in buckle assembly that securely retains a strap in a desired position.

It is yet another object of this invention to provide a buckle assembly having a plurality of mating portions engageable with a central housing.

It is still another object of this invention to provide a buckle assembly that permits a connection among several straps entering and exiting the buckle assembly at different angles.

It is yet another object of this invention to provide a strap retainer that results in memory of the relationship and positioning between a strap and the strap retainer following a desired adjustment.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
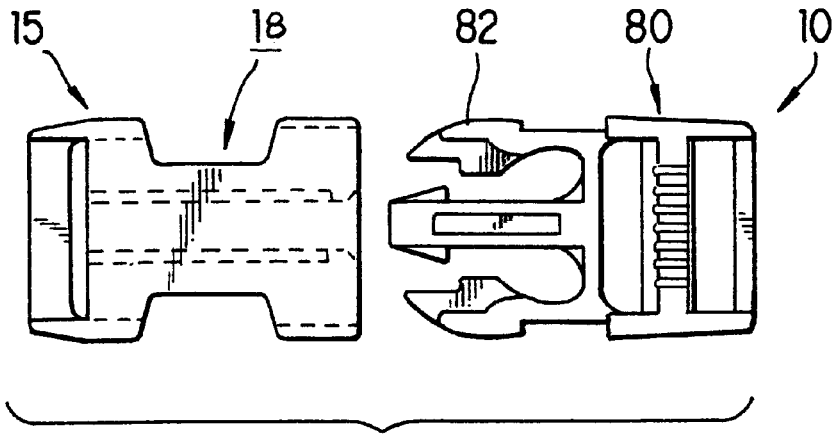
FIG. 1 PRIOR ART
FIG. 1 is a top view of a traditional buckle assembly.
Figure 2:
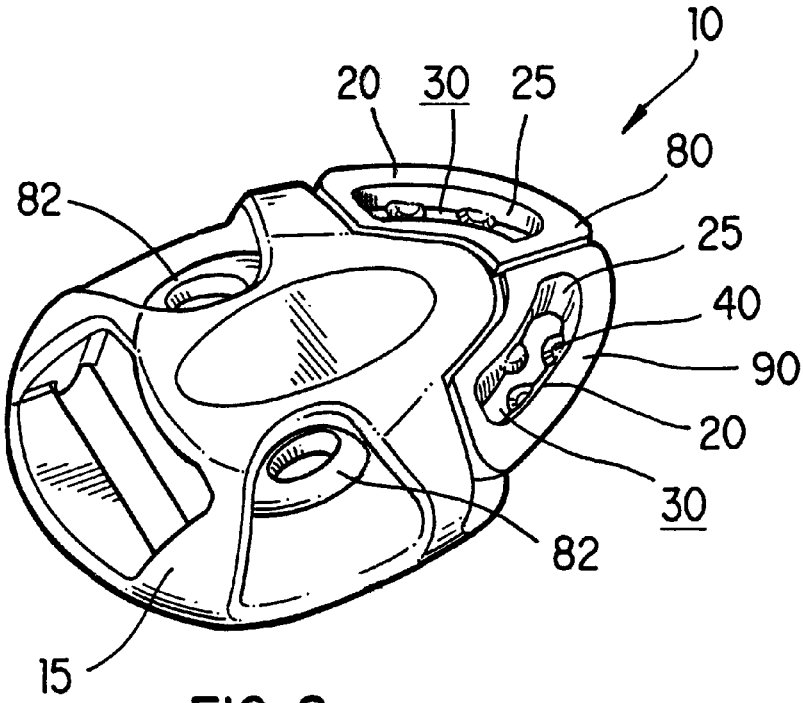
FIG. 2 is a perspective view of a buckle assembly according to one preferred embodiment of this invention.

Buckle assemblies 10, such as the prior art buckle assembly shown in FIG. 1, traditionally include housing 15 and one or more mating portions 80. Buckle assembly 10 according to one preferred embodiment of this invention is shown in FIG. 2. Mating portion 80 preferably engages with housing 15 in a fixed manner until released with a flexible flange 82 that locks in connection with opening 18 in housing.

One or more straps 70 are preferably engaged with buckle assembly 10 to complete the intended use of this invention. One or more straps 70 are adjustably or fixedly connected with respect to buckle assembly 10 and on an opposite end with respect to one or more devices that buckle assembly 10 is designed to secure, such as a child seat or a backpack.

Figure 3:
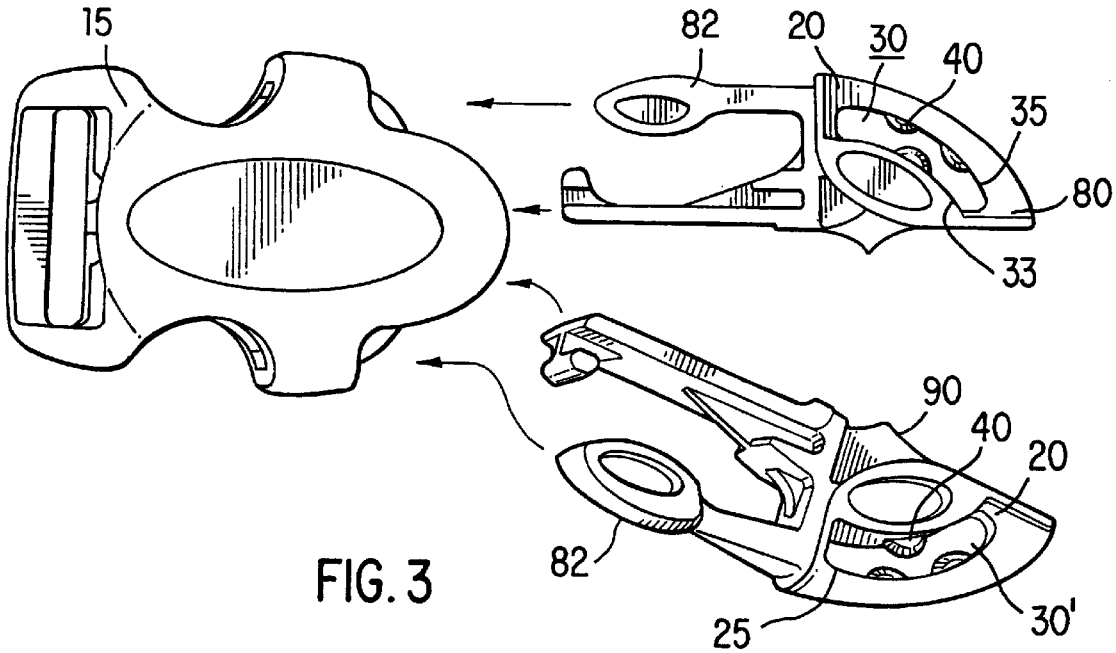
FIG. 3 is an exploded top and perspective view of a buckle assembly according to one preferred embodiment of this invention.
Figure 4:
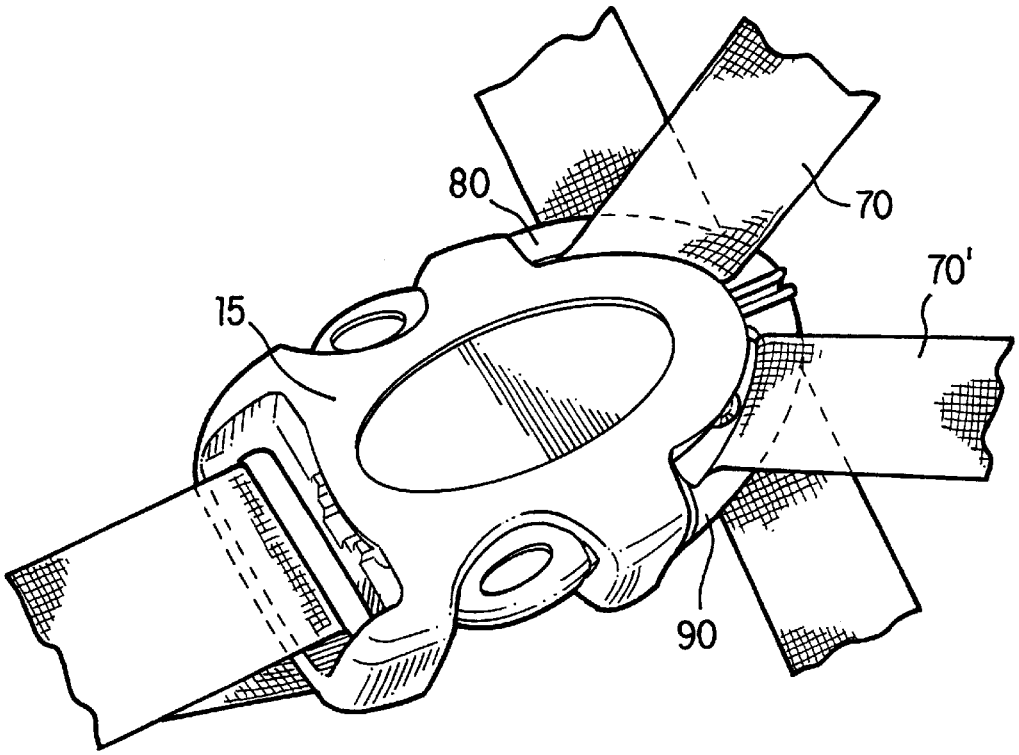
FIG. 4 is a perspective view of straps positioned in the buckle assembly shown in FIG. 3.

As shown in FIG. 1, mating portion 80 may be a single interlocking component engageable with housing 15 or may comprise two or more mating portions 80, 90 that simultaneously or sequentially engage with housing 15. Such an arrangement is shown in FIGS. 2–4 and is typically referred to as a three- or five-way buckle, depending upon the number of straps extending from buckle assembly 10. Other arrangements known to those having ordinary skill in the art may also be used in connection with this invention.

According to one preferred embodiment of this invention, strap retainer 20 is positioned within buckle assembly 10 for retaining strap 70 in a fixed position that permits adjustment when desired by the user. An important and desired feature of this invention is the ability of buckle assembly and one or more attached straps 70 to have "memory" with respect to each other so that certain desired adjustments are repeatable following any readjustment of buckle assembly 10.

Strap retaining portion 25 is formed within buckle assembly 10, and more particularly within mating portion 80, to define slot 30. According to one preferred embodiment of this invention, slot 30 is formed in an arcuate shape.

Figure 5:
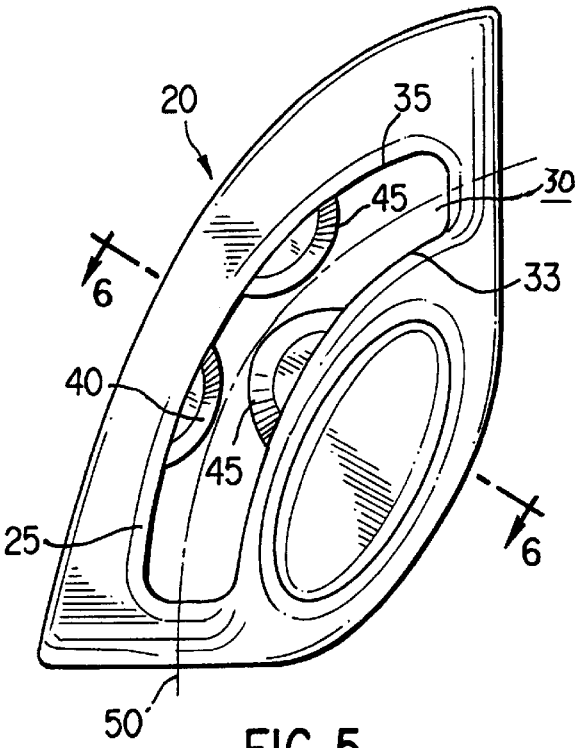
FIG. 5 is a detailed top view of a strap retainer according to one preferred embodiment of this invention.
Figure 6:
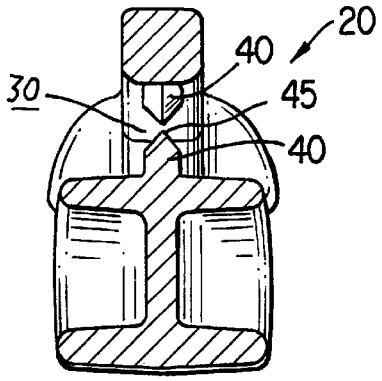
FIG. 6 is a cross-sectional view of the strap retainer shown in FIG. 5.
Figure 7:
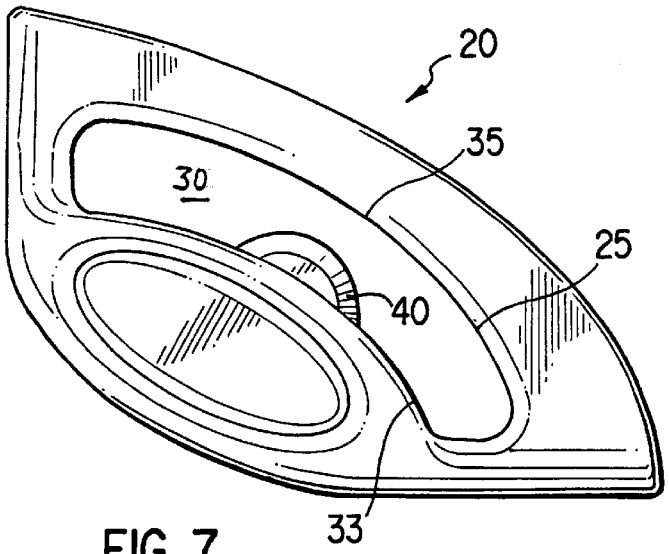
FIG. 7 is a detailed top view of a strap retainer according to another preferred embodiment of this invention.

As shown in detail in FIG. 5, one or more teeth 40 are positioned along strap retaining portion 25 and extend into slot 30. Teeth 40 may be generally arcuate shaped, as shown in FIGS. 5 and 7 or alternatively have a rectangular cross-section. For manufacturing purposes, teeth 40 preferably taper from a widest portion along strap retaining portion 25 to a narrowest portion within a center of slot 30 to form a beveled leading edge 45, as shown in cross-section in FIG. 6. Teeth 40 may be positioned longitudinally along strap retaining portion 25 as shown in the figures or may alternatively be positioned transversely with respect to strap retaining portion 25. Teeth 40 or tooth as used in this Specification may include any projection extending with respect to strap retaining portion 25 and into slot 30.

According to one preferred embodiment of this invention, at least two of the plurality of teeth 40 are spaced along outer edge 35 of strap retaining portion 25 and at least one tooth 40 of the plurality of teeth 40 are positioned along inner edge 33 of strap retaining portion 25.

According to one preferred embodiment, the at least one tooth 40 positioned along inner edge 33 is positioned at an approximate midpoint between the at least two teeth 40 along the outer edge 35. As a result, a staggered arrangement of teeth 40 is formed alternating between outer edge 35 and inner edge 33 of strap retaining portion 25. The plurality of teeth 40 may include additional teeth 40 that are alternatingly positioned between outer edge 35 of strap retaining portion 25 and inner edge 33 of strap retaining portion 25.

An imaginary centerline 50 shown in FIG. 5 bisects a length of slot 30 and forms a threshold relative to which teeth 40 may extend. According to one preferred embodiment of this invention, opposing teeth 40 extend up to and not beyond centerline 50. Alternatively, opposing teeth 40 may extend across centerline 50 to create additional obstruction within slot 30.

According to an alternate embodiment of this invention, shown in FIG. 7, a single tooth 40 is positioned along inner edge 33 of strap retaining portion 25 and extends into slot 30. Tooth 40 may be formed in a similar configuration to those described above and preferably is sized and positioned so that tooth 40 provides a significant obstruction within slot 30. Tooth 40 according to this preferred embodiment may extend up to or beyond centerline 50 of slot 30.

Strap 70 is positioned within and through slot 30. Depending upon the degree of tension required between slot 30 and strap 70, a thickness and/or width of strap 70 may be adjusted to provide more or less tension. According to the preferred embodiment of this invention shown in FIG. 4, strap 70 contacts at least three teeth 40, at least two teeth 40 on a first side of the strap and at least one tooth 40 on a second side of the strap.

According to a preferred embodiment of this invention, one or more straps 70 enter and exit buckle assembly 10 at different angles. Accordingly, strap retainer 20 permits strap 70 to enter strap retainer 20 at a first angle and exit strap retainer 20 at a second angle.

As shown in FIGS. 3 and 4, a specific buckle assembly 10 contemplated by this invention is a five-way buckle comprising housing 15 and two or more mating portions 80, 90 engageable with housing 15. Each mating portion 80, 90 preferably includes strap retaining portion 25 defining slot 30, such as first slot 30 in first mating portion 80 and second slot 30' in second mating portion 90.

According to one preferred embodiment of this invention, first slot 30 and second slot 30' are formed in a generally arcuate path converging at one extremity of housing 15. Such an arcuate path follows an outer contour of buckle assembly 10 but also permits straps 70 to enter and exit buckle assembly 10 at different angles.

As discussed in more detail above, strap retaining portion 25 may further include a configuration of three teeth 40 positioned along strap retaining portion 25. Preferably, two of the teeth 40 are spaced along outer edge 35 of strap retaining portion 25 and a third tooth 40 is positioned along inner edge 33 of strap retaining portion 25 at an approximate midpoint between the two teeth 40 along outer edge 35.

In buckle assembly shown in FIG. 4, strap 70 is positioned within first mating portion 80 and strap 70' is positioned within second mating portion 90. First mating portion 80 and second mating portion 90 preferably engage housing 15 directly adjacent to each other. In addition, first mating portion 80 and second mating portion 90 are independently removeable and engageable with respect to each other and housing 15.

While in the foregoing specification this invention has been described in relation to certain preferred embodiments thereof, and many details have been set forth for purpose of illustration, it will be apparent to those skilled in the art that the strap retainer and/or buckle assembly according to this invention is susceptible to additional embodiments and that certain of the details described herein can be varied considerably without departing from the basic principles of the invention.

I claim:

1. A strap retainer for a buckle assembly comprising:

a housing having two mating portions;

a strap retaining portion positioned within each of the two mating portions;

the strap retaining portion defining a slot positioned within the buckle assembly;

a plurality of teeth positioned along the strap retaining portion and extending into the slot, at least two of the plurality of teeth spaced along an outer edge of the strap retaining portion and at least one tooth of the plurality of teeth positioned along an inner edge of the strap retaining portion.

2. The strap retainer of claim 1 wherein the at least one tooth positioned along the inner edge is positioned at an approximate midpoint between the at least two teeth along the outer edge.

3. The strap retainer of claim 1 wherein the teeth are generally arcuate shaped.

4. The strap retainer of claim 1 wherein a thickness of the teeth taper from a widest portion along the strap retaining portion to a narrowest portion within a center of the slot to form a beveled leading edge.

5. The strap retainer of claim 1 wherein a centerline bisects a length of the slot and opposing teeth extend to the centerline.

6. The strap retainer of claim 5 wherein the opposing teeth extend across the centerline.

7. The strap retainer of claim 1 wherein the plurality of teeth are alternatingly positioned between the outer edge of the strap retaining portion and the inner edge of the strap retaining portion.

8. The strap retainer of claim 1 further comprising a strap positioned within the slot, the strap contacting at least three teeth of the plurality of teeth, at least two teeth on a first side of the strap and at least one tooth on a second side of the strap.

9. The strap retainer of claim 8 wherein the strap enters the strap retainer at a first angle and exits the strap retainer at a second angle.

10. A buckle comprising:

a housing;

a first mating portion engaging the housing, the first mating portion having a first strap retaining portion forming a first slot;

a second mating portion engaging the housing directly adjacent to the first mating portion, the second mating portion having a second strap retaining portion forming a second slot, wherein the first slot and the second slot are formed in a generally arcuate path converging at one extremity of the housing;

a plurality of teeth positioned along each strap retaining portion, at least two teeth of the plurality of teeth positioned along an outer edge of the strap retaining portion and at least one tooth of the plurality of teeth positioned along an inner edge of the strap retaining portion.

11. The buckle of claim 10 wherein opposing teeth each extend to an approximate center of the slot.

12. The buckle of claim 10 further comprising a first strap positioned within the first slot and a second strap positioned within the second slot, the first strap and the second strap each having a different angle of exit from an angle of entry.

13. The buckle of claim 10 further comprising at least one additional mating portion engaging with the housing.

14. A buckle assembly comprising:

a housing;

a mating portion engaging the housing, the mating portion having a strap retaining portion defining a slot;

three teeth positioned along the strap retaining portion, each of the teeth having an arcuate shape and a beveled leading edge, two of the teeth spaced along an outer edge of the strap retaining portion and a third tooth positioned along an inner edge of the strap retaining portion at an approximate midpoint between the two teeth along the outer edge, wherein a centerline bisects a length of the slot and opposing teeth extend at least up to the centerline.

15. The buckle of claim 14 wherein the slot is an arcuate slot.

16. The buckle of claim 14 further comprising at least one additional pair of teeth.

17. The buckle of claim 14 further comprising a second mating portion engaging with the housing, the second mating portion including a second strap retaining portion forming a second slot.

18. A strap retainer for a buckle assembly comprising:

a strap retaining portion defining a slot positioned within the buckle assembly;

at least one tooth, having a generally arcuate shape and forming a beveled leading edge, positioned along the strap retaining portion and extending into the slot, the at least one tooth positioned along an inner edge of the strap retaining portion, wherein a centerline bisects a length of the slot and the at least one tooth extends across the centerline.

19. The strap retainer of claim 18 wherein a plurality of teeth are alternatingly positioned between an outer edge of the strap retaining portion and the inner edge of the strap retaining portion.

20. A strap retainer for a buckle assembly comprising:

a strap retaining portion defining a slot positioned within the buckle assembly;

a plurality of teeth positioned along the strap retaining portion and extending into the slot, at least two of the plurality of teeth spaced along an outer edge of the strap retaining portion and at least one tooth of the plurality of teeth positioned along an inner edge of the strap retaining portion, wherein a centerline bisects a length of the slot and the opposing teeth extend across the centerline.

21. A buckle assembly comprising:

a housing;

a mating portion engaging the housing, the mating portion having a strap retaining portion defining a slot;

three teeth positioned along the strap retaining portion, two of the teeth spaced along an outer edge of the strap retaining portion and a third tooth positioned along an inner edge of the strap retaining portion at an approximate midpoint between the two teeth along the outer edge; and a second mating portion engaging with the housing, the second mating portion including a second strap retaining portion forming a second slot.

* * * * *